US007771572B2

(12) United States Patent
Lee

(10) Patent No.: US 7,771,572 B2
(45) Date of Patent: Aug. 10, 2010

(54) CONE CRUSHER FIXED TOOTHED PLATE FIXING STRUCTURE

(75) Inventor: Hou-Kun Lee, Yangmei Township, Taoyuan County (TW)

(73) Assignee: Minyu Machinery Corp., Ltd., Taoyuan County (TW)

( * ) Notice: Subject to any disclaimer, the term of this patent is extended or adjusted under 35 U.S.C. 154(b) by 0 days.

(21) Appl. No.: 11/703,837

(22) Filed: Feb. 8, 2007

(65) Prior Publication Data

US 2008/0191076 A1 Aug. 14, 2008

(51) Int. Cl.
*B02C 15/10* (2006.01)

(52) U.S. Cl. ..... 204/207

(58) Field of Classification Search ..... 241/207–216, 241/244

See application file for complete search history.

(56) References Cited

U.S. PATENT DOCUMENTS 3,834,633 A * 9/1974 Dougall et al. ..... 241/295
4,289,280 A * 9/1981 Mitrofanov et al. ..... 241/207
4,512,525 A * 4/1985 Cameron ..... 241/207
5,775,607 A * 7/1998 Bayliss et al. ..... 241/207
2007/0272780 A1* 11/2007 Olsson et al. ..... 241/207

* cited by examiner

*Primary Examiner*—Faye Francis
(74) *Attorney, Agent, or Firm*—Muncy, Geissler, Olds & Lowe, PLLC

(57) ABSTRACT

A cone crusher fixed toothed plate fixing structure, including an upper chamber, a locking device, a fixed toothed plate and a plurality of bolt members. A passageway penetrates the interior of the upper chamber, and the fixed toothed plate, provided with protrusions corresponding to protruding pieces of the upper chamber and stop pieces of the locking device and clasping notches corresponding to indentations of the upper cover and recesses of the locking device, is disposed therein, and a ledge located interior of the passageway enables the locking device to be disposed thereon. The plurality of bolt members are rotated and bolted into a plurality of screw holes to enable abutting against the ledge, whereupon a locking action raises the fixed toothed plate and attaches it to the upper chamber, thereby enabling the fixed toothed plate G to realize simple assembly of the fixing structure, and achieve effectiveness to crush stones.

3 Claims, 11 Drawing Sheets

CONE CRUSHER FIXED TOOTHED PLATE FIXING STRUCTURE

BACKGROUND OF THE INVENTION (a) Field of the Invention

The art of the present invention provides a cone crusher fixed toothed plate fixing structure, and more particularly provides a fixed toothed plate that uses bolt members to abut against a ledge to effect a locking action.

(b) Description of the Prior Art

Referring to FIG. 1, FIG. 2 and FIG. 3, which show a conventional fixed toothed plate fixing structure A, wherein a fixed toothed plate B is fixed to an upper chamber C to realize a crushing action. When fixing the fixed toothed plate B to the upper chamber C, projecting lugs B1 located on the fixed toothed plate B are made to penetrate into holes C1 of the upper chamber C, after which U-shaped screws B2 are used to clamp round the projecting lugs B1, wherein each of the U-shaped screws B2 penetrates a lower filling piece B3, a rubber filling piece B4, an upper filling piece B5 and a retaining filling piece B6 and bolted down using a nut B7. Moreover, the lower filling piece B3, the rubber filling piece B4, the upper filling piece B5 and the retaining filling piece B6 are fixedly secured by means of a stop plate C2, thereby achieving securing the fixed toothed plate B to the upper chamber C. However, a worker must pass the screws B2 through small and narrow openings C3 before being able to bolt down the nuts B7 thereon. Such a fixing method is considerably troublesome, and assembly is time consuming and laborsome. Moreover, the U-shaped screws B2 need to be specially custom made, which correspondingly further increases material cost.

Hence, the inventor of the present invention proposes to resolve and surmount existent technical difficulties to eliminate the aforementioned shortcomings of prior art.

SUMMARY OF THE INVENTION

The art of the present invention provides a cone crusher fixed toothed plate fixing structure, and more particularly provides a fixed toothed plate that uses bolt members to abut against a ledge to effect a locking action, which causes the fixed toothed plate to raise, thereby enabling the fixed toothed plate to be securely joined and attached to an upper chamber, whereby assembly of the fixing device is simply completed, and effectiveness of stone cone crushing can be achieved.

To enable a further understanding of said objectives and the technological methods of the invention herein, brief description of the drawings is provided below followed by detailed description of the preferred embodiments.

DETAILED DESCRIPTION OF THE PREFERRED EMBODIMENTS

Figure 1:
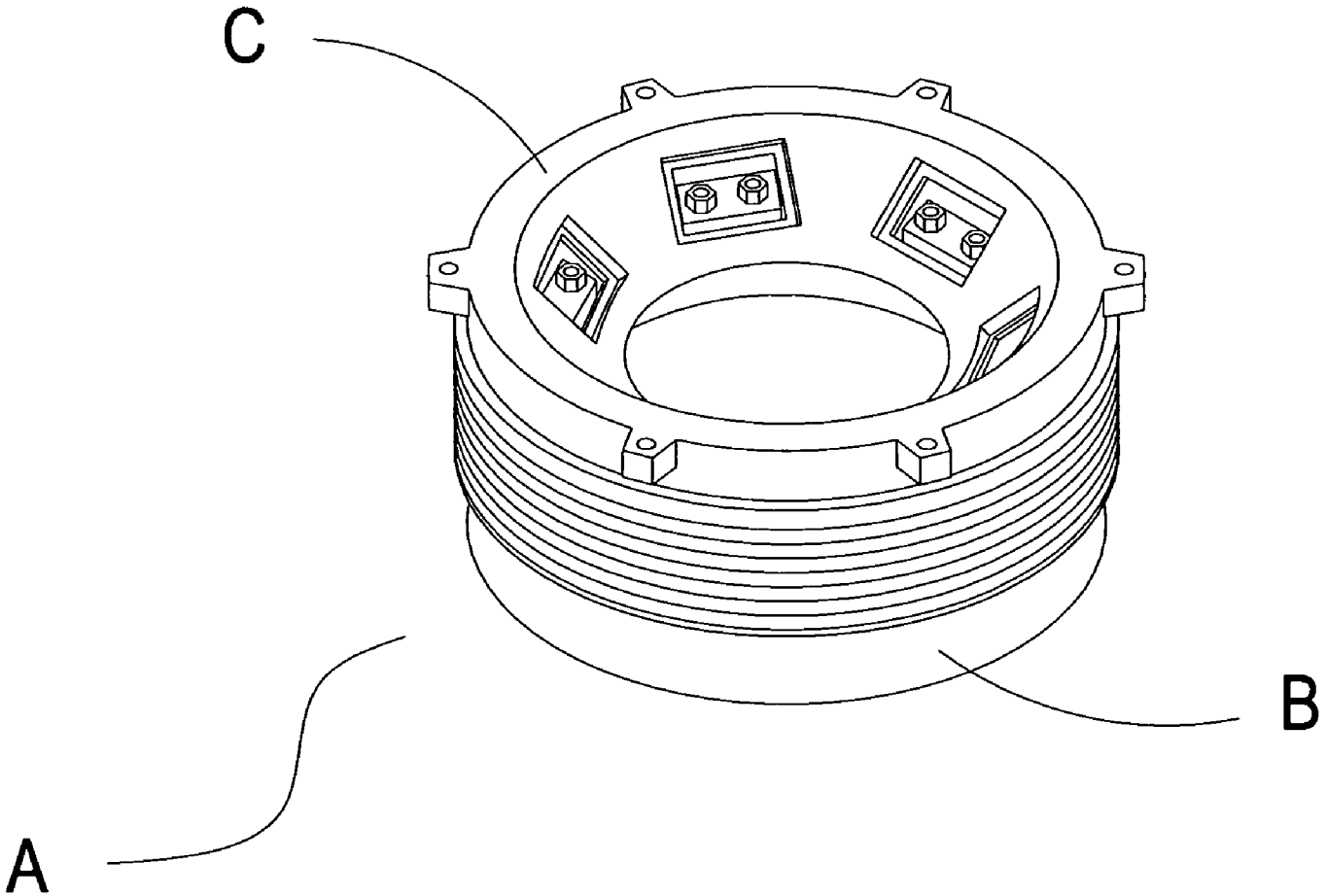
FIG. 1 Prior Art
FIG. 1 shows an elevational view of prior art.
Figure 2:
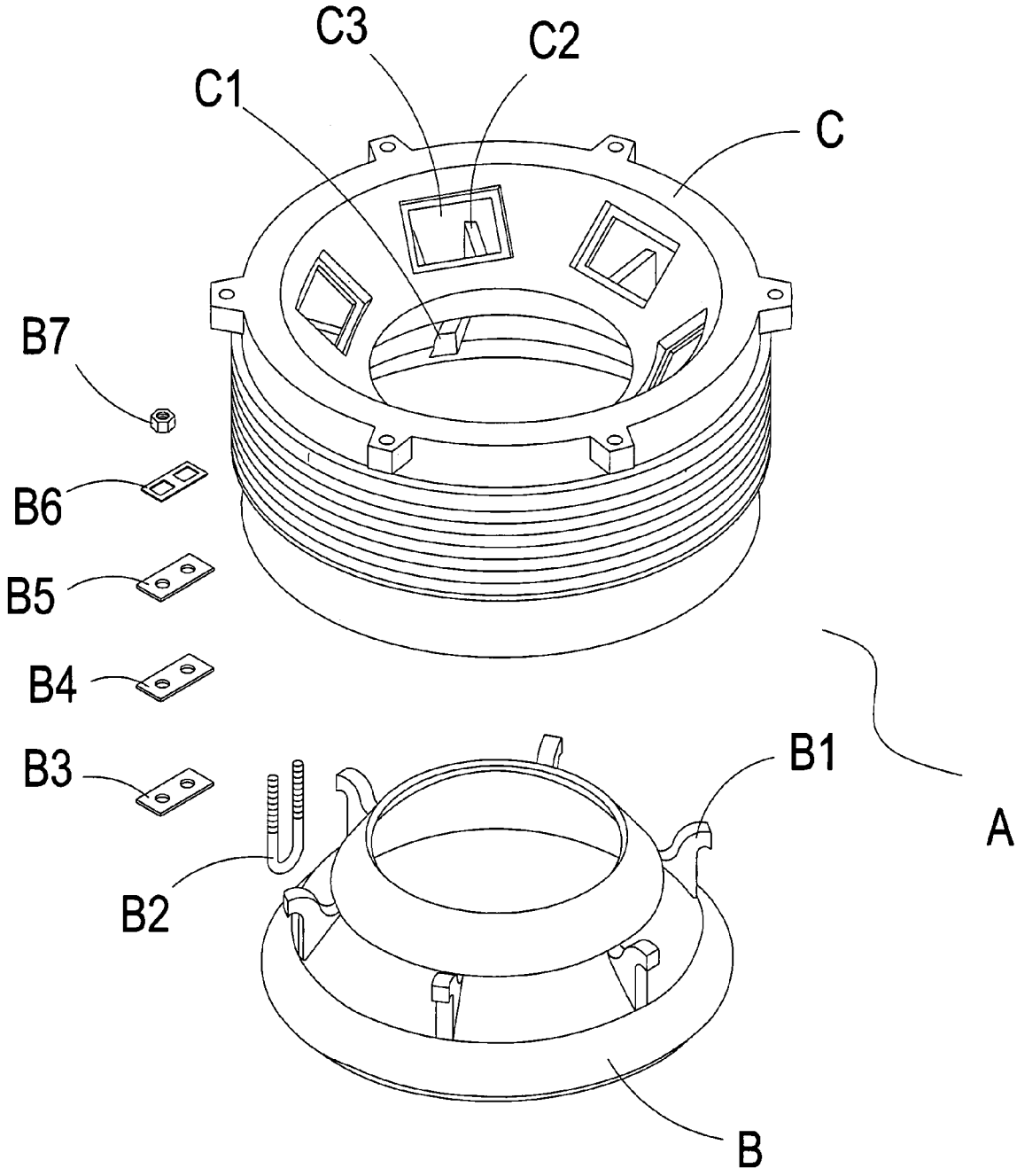
FIG. 2 Prior Art
FIG. 2 shows an exploded elevational view of prior art.
Figure 3:
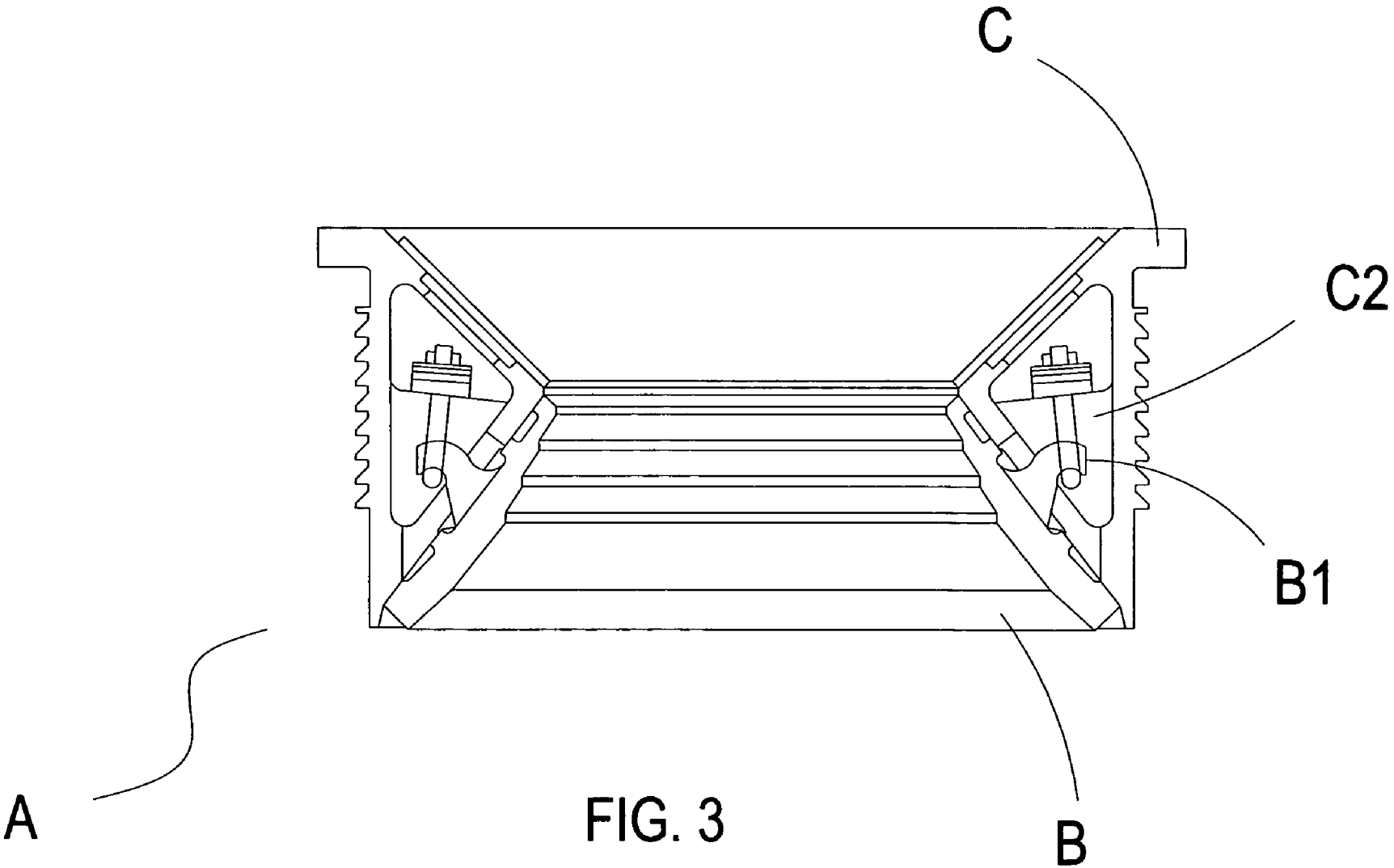
FIG. 3 Prior Art
FIG. 3 shows a cutaway view of prior art.
Figure 4:
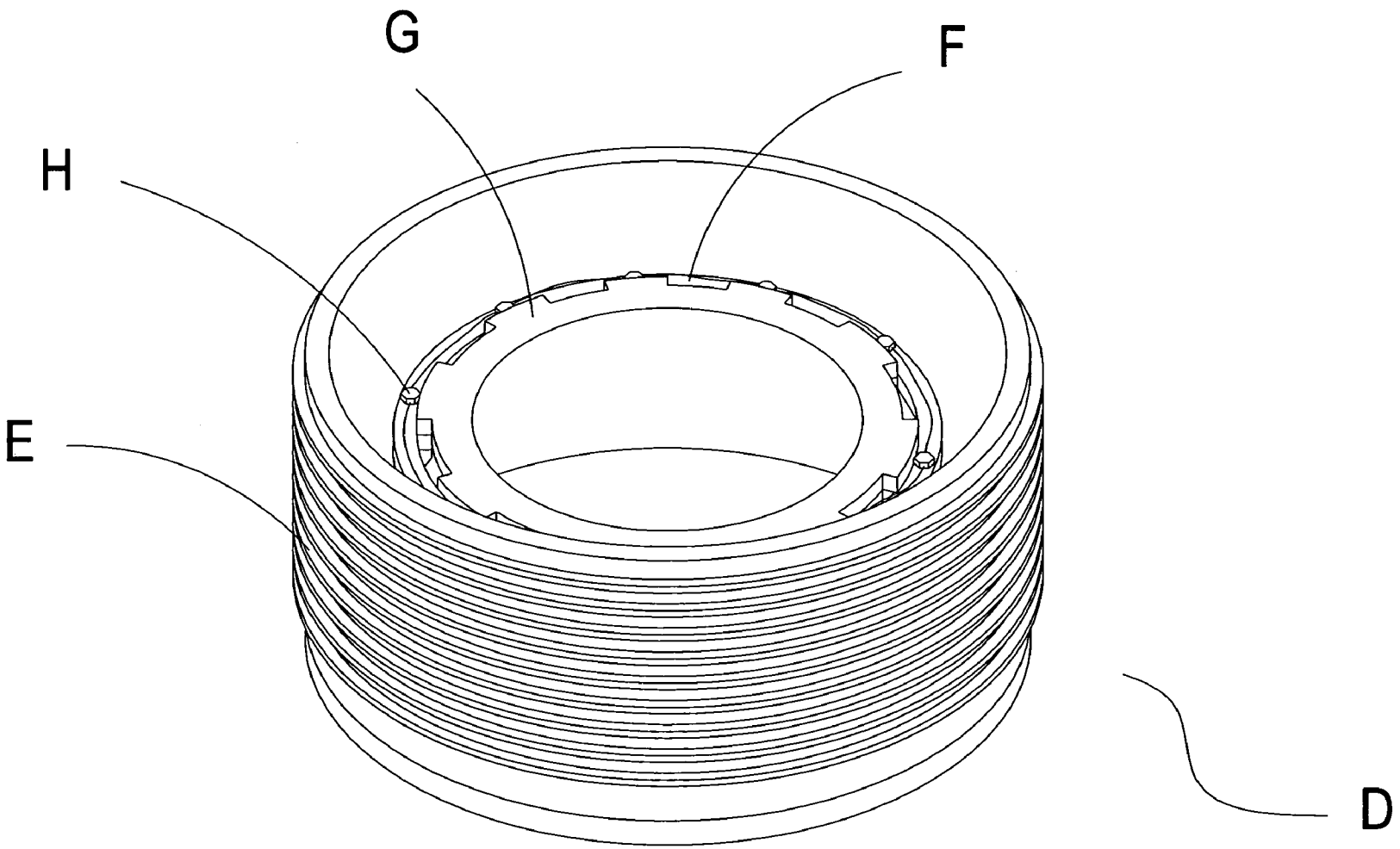
FIG. 4 shows an elevational view of the present invention.
Figure 5:
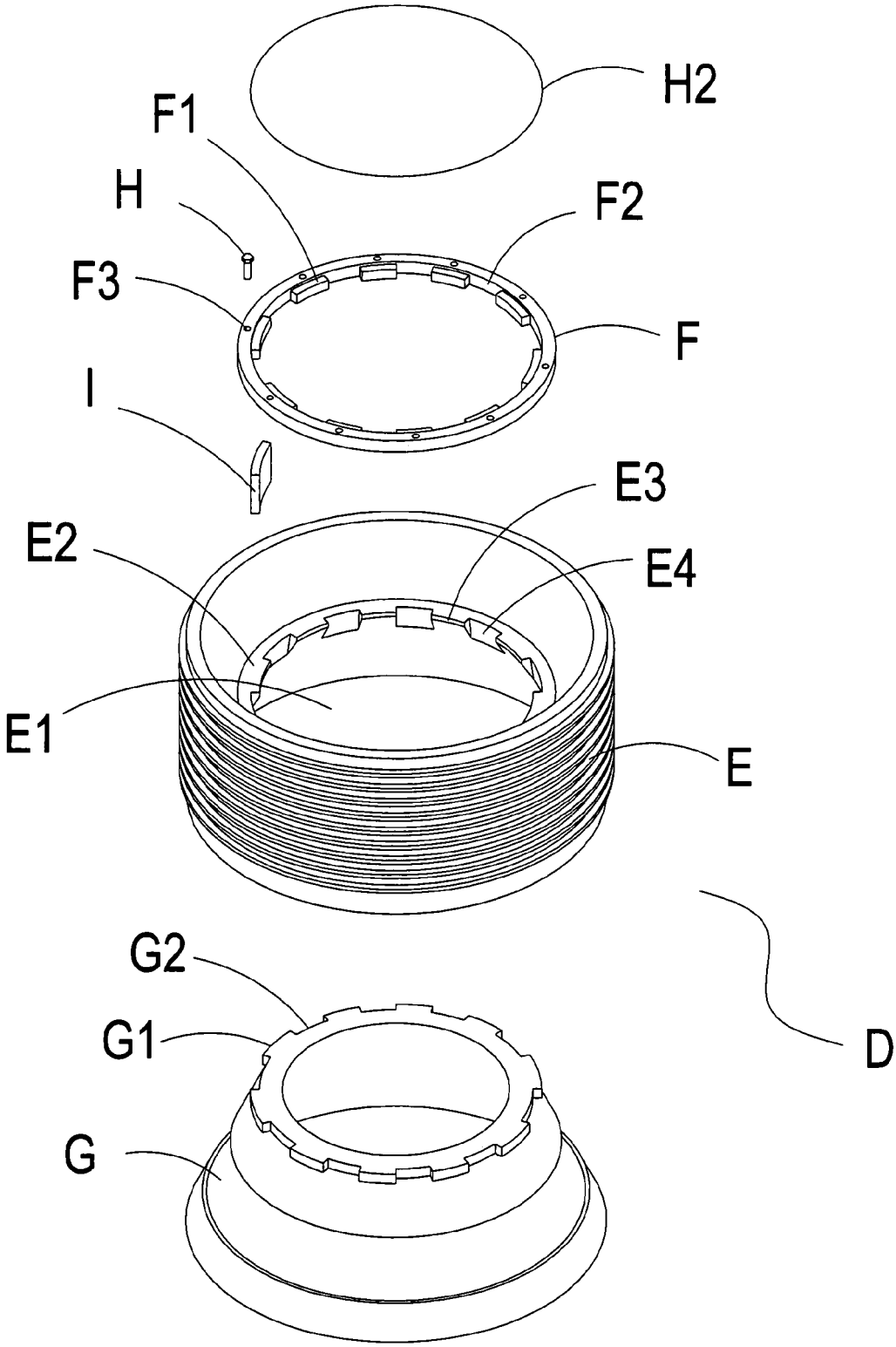
FIG. 5 shows an exploded elevational view of the present invention.
Figure 6:
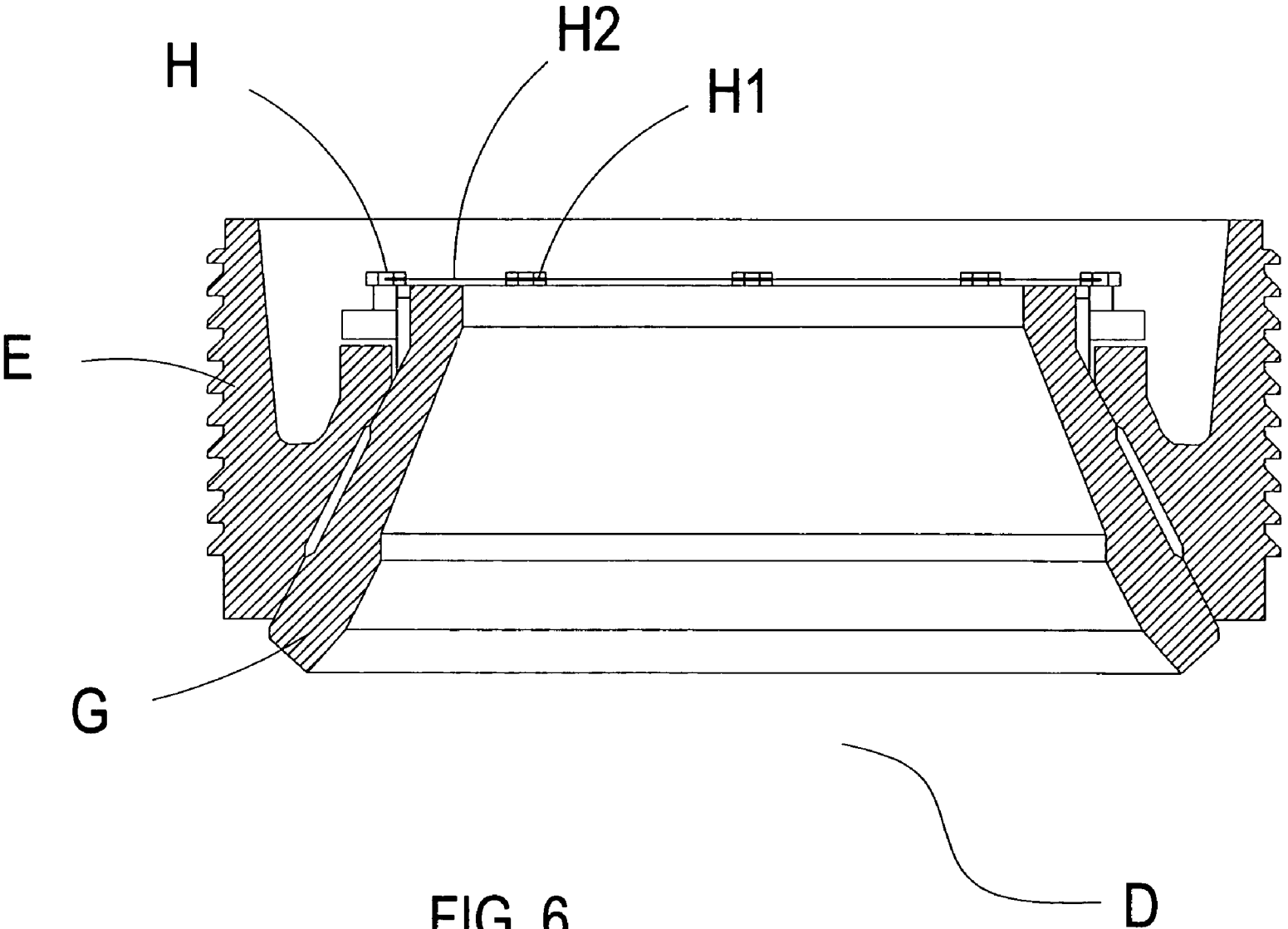
FIG. 6 shows a cutaway view of the present invention.

Referring to FIG. 4, FIG. 5 and FIG. 6, which show a cone crusher fixed toothed plate fixing structure of the present invention, wherein a fixing structure D is structured to comprise an upper chamber E, a locking device F, a fixed toothed plate G and a plurality of bolt members H. A passageway E1 penetrates the interior of the upper chamber E, and a ledge E2 is located interior of the passageway E1. Moreover, a plurality of protruding pieces E3 are located on and extend from the ledge E2, and a plurality of indentations E4 are configured on the ledge E2 between the plurality of protruding pieces E3. The locking device F is disposed on the ledge E2, and a plurality of screw holes F3 are defined in the locking device F. Moreover, a plurality of stop pieces F1 are located on the locking device corresponding to positions of the plurality of protruding pieces E3, and a plurality of recesses F2 are configured between the plurality of stop pieces F1. The fixed toothed plate G is provided with protrusions G1 corresponding to the protruding pieces E3 and the stop pieces F1, and the fixed toothed plate G is disposed in the passageway E1 of the upper chamber E. Moreover, the fixed toothed plate G is configured with clasping notches G2 corresponding to the indentations E4 and the recesses F2. The plurality of bolt members H respectively penetrate the plurality of screw holes F3, and an end of each of the bolt members H abuts against the ledge E2 of the upper chamber E. Furthermore, a through hole H1 perforates each of the bolt members H, thereby enabling a retaining wire H2 to penetrate the through holes H1, and a locking key I is disposed between the indentations E4, the recesses F2 and the clasping notches G2.

Figure 7:
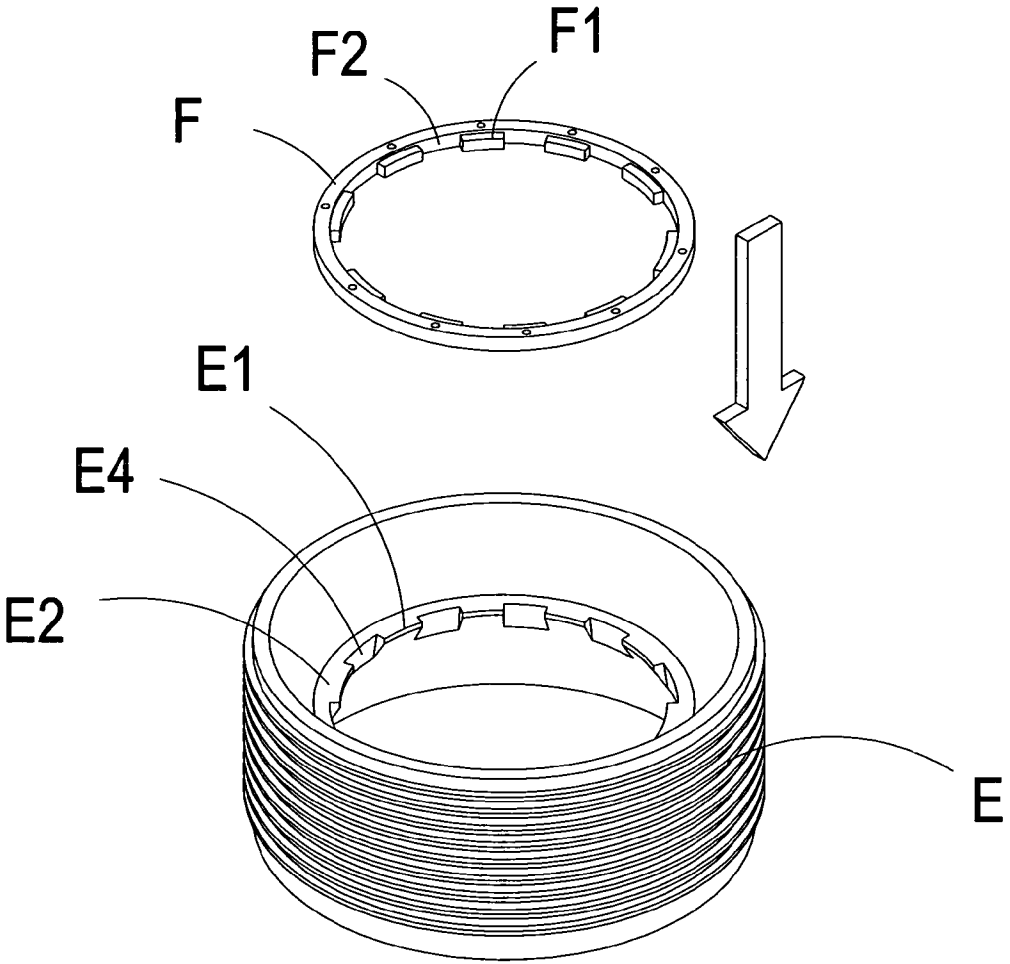
FIG. 7 shows a first schematic view of an embodiment according to the present invention.
Figure 8:
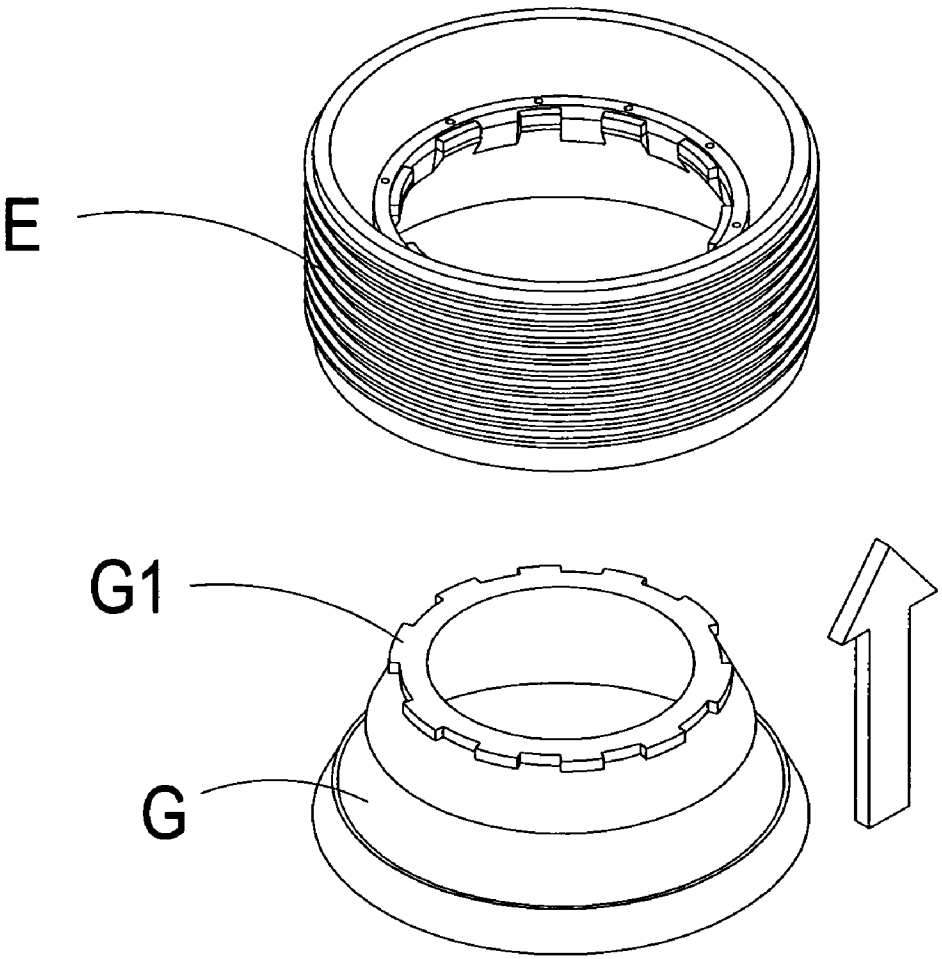
FIG. 8 shows a second schematic view of the embodiment according to the present invention.
Figure 9:
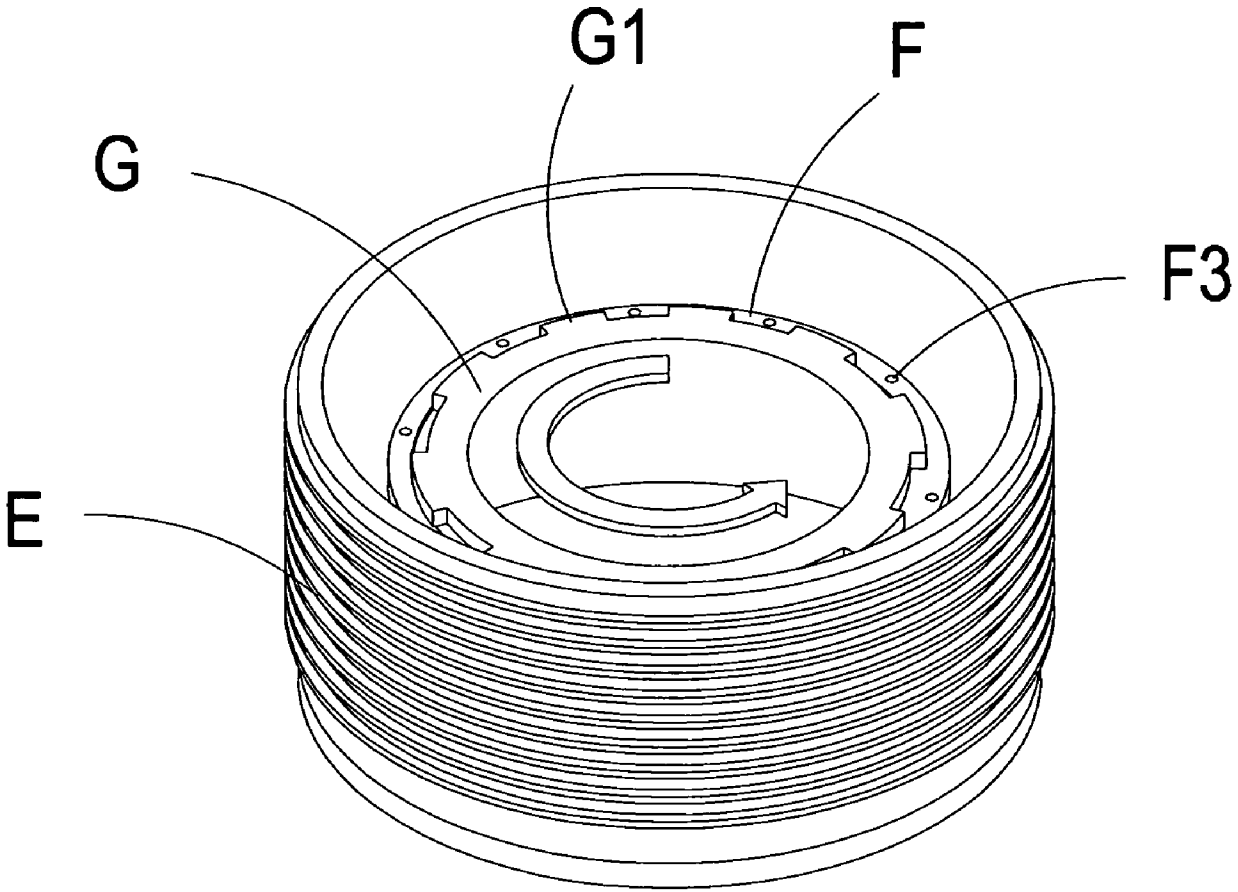
FIG. 9 shows a third schematic view of the embodiment according to the present invention.

Referring to FIG. 7, FIG. 8 and FIG. 9, which show an embodiment of the cone crusher fixed toothed plate fixing structure of the present invention, wherein the ledge E2 is located interior of the upper chamber E, and the locking device F is disposed on the ledge E2. When the locking device F is disposed on the ledge E2, the plurality of stop pieces F1 of the locking device F correspond to the plurality of protruding pieces E3 of the ledge E2, and the plurality of recesses F2 of the locking device F simultaneously correspond to the plurality of indentations E4 of the ledge E2, at which time the protrusions G1 of the fixed toothed plate G are able to protrude through and lodge into the indentations E4 of the upper chamber E and the recesses F2 of the locking device F. After passing through the indentations E4 and the recesses F2, rotating of the fixed toothed plate G causes the protrusions G1 of the fixed toothed plate G to stop on the stop pieces F1 of the locking device F, thereby enabling the fixed toothed plate G to be fixedly secured in the upper chamber E by the protrusions G1 abutting against the stop pieces F1 of the locking device F.

Figure 10:
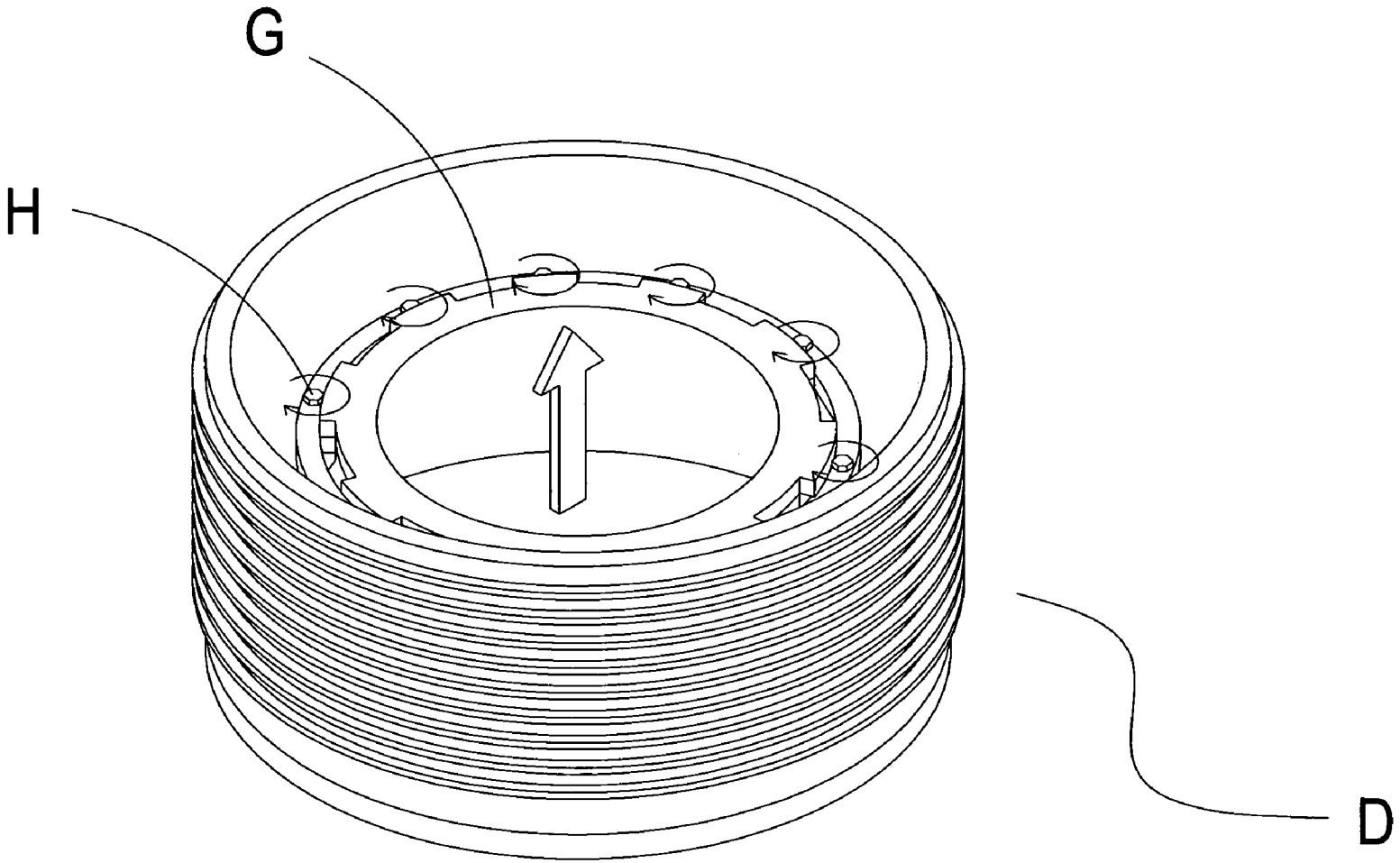
FIG. 10 shows a fourth schematic view of the embodiment according to the present invention.
Figure 11:
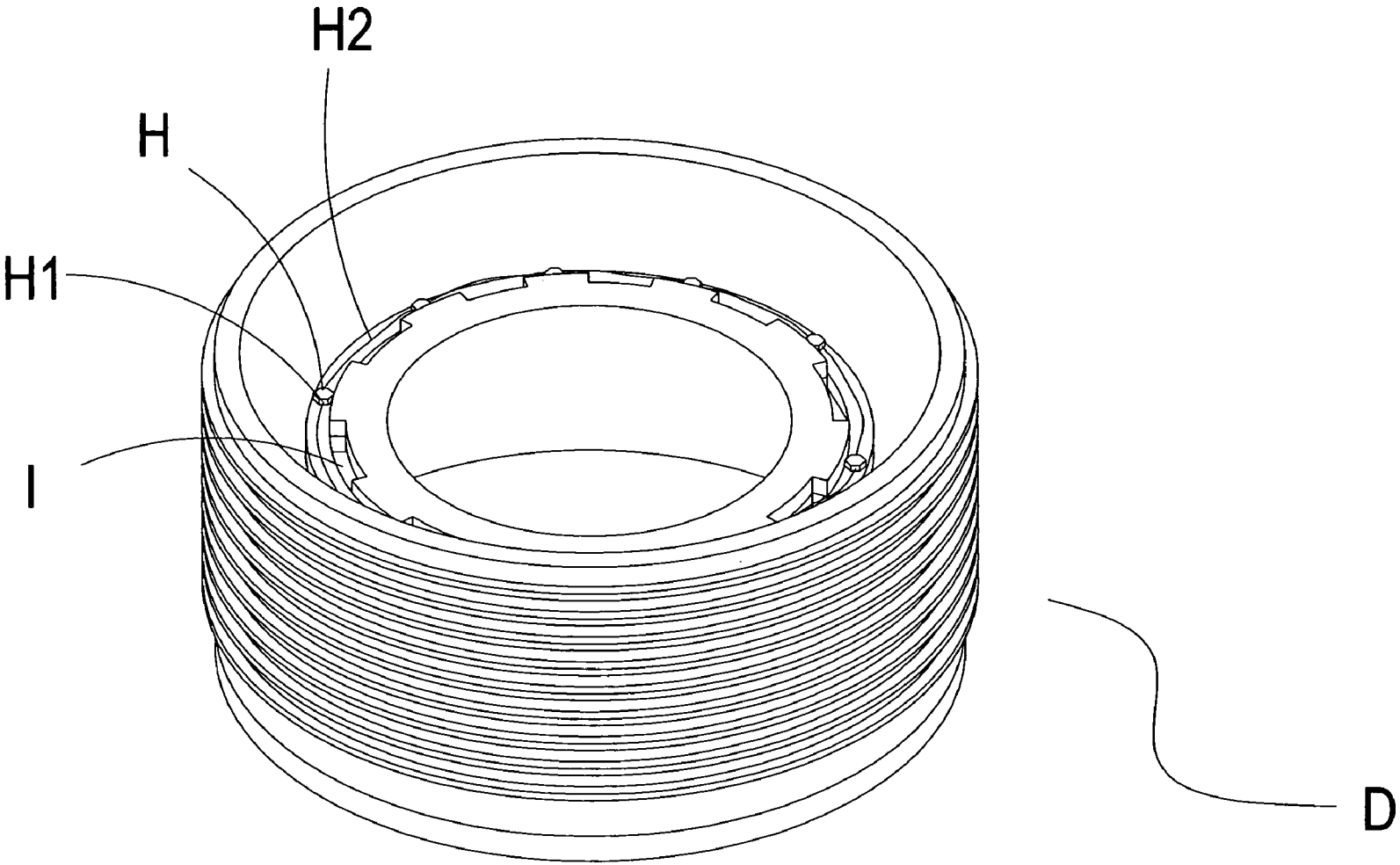
FIG. 11 shows a cutaway schematic view of the present invention.

Referring to FIG. 9, FIG. 10 and FIG. 11, the plurality of screw holes F3 perforating the locking device F enable the plurality of bolt members H to penetrate and be bolted therein. After the bolt members H have penetrated the screw holes F3, ends of the bolt members F3 abut against the ledge E2 of the upper chamber E (see FIG. 5), whereupon a locking action is performed on the bolt members H, at which time the fixed toothed plate G is raised and, at the same time, attached to the upper chamber E, thereby enabling the fixed toothed plate G to be securely joined and mounted to the upper chamber E, whereby assembly of the fixing device D is simply completed, and effectiveness of stone cone crushing can be achieved.

The locking key I is disposed between the indentations E4, the recesses F2 and the clasping grooves G2 (see FIG. 5), thereby enabling fixedly positioning the upper chamber E, the locking device F and the fixed toothed plate G, which prevents rotating and coming apart of the upper chamber E, the locking device F and the fixed toothed plate G during movement therebetween. Furthermore, the through holes H1 defined in the bolt members H enable the retaining wire H2 to pass therethrough and fix the plurality of bolt members H to achieve the objective of preventing the bolt members H from becoming lose due to rotation.

In order to better explicitly disclose advancement and practicability of the present invention, a comparison with prior art is described hereinafter:

Shortcomings of Prior Art

1. Fixing method is troublesome.
2. Assembly is time consuming and laborsome,
3. Needs custom made components.
4. High cost.

Advantages of the Present Invention

1. Fixing method is simple and convenient.
2. Saves on labor and assembly time.
3. Does not need custom made components.
4. Reduces cost.
5. Provided with advancement and practicability.
6. Enhances industrial competitiveness.

In conclusion, the present invention in overcoming structural shortcomings of prior art has assuredly achieved effectiveness of anticipated advancement, and, moreover, is easily understood by persons unfamiliar with related art.

Furthermore, contents of the present invention have not been publicly disclosed prior to this application, and practicability and advancement of the present invention clearly comply with essential elements as required for a new patent application. Accordingly, a new patent application is proposed herein.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A cone crusher fixed toothed plate fixing structure, comprising:

an upper chamber having a passageway penetrating the interior thereof, and a ledge is located interior of the passageway, a plurality of protruding pieces are located on and extend from the ledge, and a plurality of indentations are configured between the plurality of protruding pieces;

a locking device disposed on the ledge, a plurality of screw holes are defined in the locking device, and a plurality of stop pieces are located on the locking device corresponding to positions of the plurality of protruding pieces, a plurality of recesses are configured between the plurality of stop pieces;

a fixed toothed plate disposed in the passageway of the upper chamber and configured with protrusions and clasping notches; and a plurality of bolt members, which respectively penetrate the screw holes of the locking device, and an end of each of the bolt members abuts against the ledge of the upper chamber;

whereby the locking device is disposed on the ledge to enable the plurality of protruding pieces and the plurality of indentations correspond to the plurality of stop pieces and the plurality of recesses, the fixed toothed plate is disposed within the passageway of the upper chamber to enable the protrusions to abut against the stop pieces, and the bolt members are bolted down, thereby enabling the bolt members to effectively raise position of the fixed toothed plate and mount the fixed toothed plate within the upper chamber.

2. The cone crusher fixed toothed plate fixing structure according to claim 1, wherein a through hole is defined in each of the bolt members, thereby enabling a retaining wire to pass therethrough and fix the plurality of bolt members to achieve the objective of preventing the bolt members from becoming lose due to rotation.

3. The cone crusher fixed toothed plate fixing structure according to claim 1, wherein a locking key is disposed between the indentations, the recesses and the clasping notches, thereby enabling fixedly positioning the upper chamber, the locking device and the fixed toothed plate, which prevents rotating and coming apart of the upper chamber, the locking device and the fixed toothed plate during movement therebetween.

* * * * *